US005344738A

United States Patent [19]

Kmiecik-Lawrynowicz et al.

[11] Patent Number: 5,344,738

[45] Date of Patent: Sep. 6, 1994

[54] PROCESS OF MAKING TONER COMPOSITIONS

[75] Inventors: Grazyna E. Kmiecik-Lawrynowicz, Burlington; Raj D. Patel, Oakville; Michael A. Hopper, Toronto, all of Canada

[73] Assignee: Xerox Corporation, Stamford, Conn.

[21] Appl. No.: 83,146

[22] Filed: Jun. 25, 1993

[51] Int. Cl.[5] ..... G03G 9/087

[52] U.S. Cl. ..... 430/137; 523/322; 523/335; 523/339

[58] Field of Search ..... 430/137; 523/322, 335, 523/339

[56] References Cited

U.S. PATENT DOCUMENTS

| | | | |
|---|---|---|---|
| 4,137,188 | 1/1979 | Uetake et al. | 252/62.54 |
| 4,558,108 | 12/1985 | Alexandru et al. | 526/340 |
| 4,797,339 | 1/1989 | Maruyama et al. | 430/109 |
| 4,983,488 | 1/1991 | Tan et al. | 430/137 |
| 4,996,127 | 2/1991 | Hasegawa et al. | 430/109 |
| 5,278,020 | 1/1994 | Grushkin et al. | 430/137 |
| 5,290,654 | 3/1994 | Sacripante et al. | 430/137 |

*Primary Examiner*—Roland Martin
*Attorney, Agent, or Firm*—E. O. Palazzo

[57] ABSTRACT

A process for the preparation of toner compositions with a volume median particle size of from about 1 to about 25 microns, which process comprises:

(i) preparing by emulsion polymerization an anionic charged polymeric latex of submicron particle size, and comprised of resin particles and anionic surfactant;

(ii) preparing a dispersion in water, which dispersion is comprised of optional pigment, an effective amount of cationic flocculant surfactant, and optionally a charge control agent;

(iii) shearing the dispersion (ii) with the polymeric latex thereby causing a flocculation or heterocoagulation of the formed particles of optional pigment, resin and charge control agent to form a high viscosity gel in which solid particles are uniformly dispersed;

(iv) stirring the above gel comprised of latex particles, and oppositely charged dispersion particles for an effective period of time to form electrostatically bound relatively stable toner size aggregates with narrow particle size distribution; and (v) heating the electrostatically bound aggregated particles at a temperature above the resin glass transition temperature (Tg) thereby providing the toner composition comprised of resin, optional pigment and optional charge control agent.

37 Claims, No Drawings

PROCESS OF MAKING TONER COMPOSITIONS

BACKGROUND OF THE INVENTION

The present invention is generally directed to toner processes, and more specifically to aggregation and coalescence processes for the preparation of toner compositions. In embodiments, the present invention is directed to the economical preparation of toners without the utilization of the known pulverization and/or classification methods, and wherein toners with an average volume diameter of from about 1 to about 25, and preferably from about 1 to about 10 microns, and a narrow GSD of from about 1.16 to about 1.26 can be obtained. The resulting toners can be selected for known electrophotographic imaging and printing processes, including color processes, and lithography. In embodiments, the present invention is directed to a process comprised of dispersing a pigment and optionally a charge control agent or additive in an aqueous mixture containing an ionic surfactant in a controlled effective amount of, for example, from about 0.01 percent to about 10 percent by weight of the aqueous mixture and shearing this mixture with a latex mixture comprised of suspended resin particles of, for example, from about 0.01 micron to about 2 microns in volume diameter in an aqueous solution containing a counterionic surfactant in amounts of from about 1 percent to about 10 percent with opposite charge to the ionic surfactant of the pigment dispersion, thereby causing a flocculation of resin particles, pigment particles and optional charge control agent, followed by stirring of the flocculent mixture, which is believed to form statically bound aggregates of from about 1 micron to about 10 microns, comprised of resin, pigment and optionally charge control agent. Subsequently, the mixture formed is heated to generate toner particles with an average particle volume diameter of from about 1 to about 20 microns. It is believed that during the heating stage the components of the aggregated particles fuse together to form composite toner particles. The size of the final toner particles can be controlled by the amount of the cationic surfactant added to cause the aggregation of latex particles with pigment particles (flocculation). An increase of from 0.5:1 to 4:1 molar ratio in the concentration of the flocculant (cationic surfactant) causes in embodiments an increase of from a size of 3 to a size of 9 microns in volume average diameter of the toner particles. However, in embodiments there is a certain minimum of about 0.01 percent to about 0.2 percent concentration (or 0.5:1 molar ratio of the cationic surfactant in the pigment to the anionic surfactant in the latex) of the flocculant (cationic surfactant) required for the aggregation of the submicron latex particles with the pigment particles to occur, and below this minimum concentration no aggregation may be observed. The flocculant concentration also controls the particle size distribution of the aggregates. Also, an increase in the concentration of the flocculant improves the particle size distribution from 1.4 to 1.2, especially at low 0.5:1 molar ratio concentrations, and also reduces the time of aggregation from, for example, about 12 to about 2 hours.

In another embodiment thereof, the present invention is directed to an in situ process comprised of first dispersing a pigment in an aqueous mixture containing a controlled amount of a cationic surfactant, such as benzalkonium chloride, other straight chain fatty alkylammonium compounds or cyclic alkylammonium compound, or polymeric cationic surfactant. The cationic surfactant used acts not only as a flocculant but also as a dispersant for the pigment, and in the process there can be utilized a high shearing device, such as a Brinkman Polytron, microfluidizer or sonicator, thereafter shearing this mixture with a latex of suspended resin particles such as poly(styrene/butadiene/acrylic acid) or poly(styrene/butylacrylate/acrylic acid), and of particle size ranging from 0.01 to about 0.5 micron as measured by the Brookhaven nanosizer in an aqueous surfactant mixture containing an anionic surfactant, such as sodium dodecylbenzene sulfonate (for example NEOGEN R TM or NEOGEN SC TM) and nonionic surfactant such as alkyl phenoxy poly(ethylenoxy)ethanol (for example IGEPAL 897 TM or ANTAROX 897 TM), thereby resulting in a flocculation, or heterocoagulation of the resin particles with the pigment particles, and which on further stirring of 1 to 4 hours at 200 to 500 rpm and heating about 5° to about 50° C. above the resin Tg, which Tg is usually in the range of about 50° to about 80° C., and preferably in the range of 52° to 65° C., at temperatures between about 60° to about 95° C. results in the fusing of toner composites, from about 3 to about 20 microns, which size can be controlled by the amount or molar ratio, in range of 0.5:1 to 4:1, of cationic surfactant introduced with the pigment dispersion to the anionic surfactant introduced with the polymeric anionic latex. This is followed by washing with, for example, hot water to remove surfactants, and drying whereby toner particles comprised of resin and pigment with various particle size diameters can be obtained, such as from about 1 to about 25 microns.

The aforementioned toners are especially useful for the development of colored images with excellent line and solid resolution, and wherein substantially no background deposits are present. While not being desired to be limited by theory, it is believed that the flocculation or heterocoagulation is provided by the neutralization of the pigment mixture containing the pigment and cationic surfactant absorbed on the pigment surface with the resin mixture containing the resin particles and anionic surfactant absorbed on the resin. This process is accompanied by the viscosity build up from about 2 centipoise to about 5,000, and preferably 2,000 centipoise due to the formation of a gel - open space network of the aggregates. The viscosity of this gel blend is dependant on the amount of the cationic flocculant added, and it will initially increase with an increase of the cationic surfactant concentration. The cationic surfactant can also lower the negative charge on the latex particles thus causing their destabilization and tendency to aggregate. Further, an increase of the cationic surfactant concentration increases the rate of the aggregation, and narrows down the particles size distribution as at higher concentration all the fines-submicron size particles are collected more efficiently. Thereafter, heating about above the resin Tg, for example from 60° to 95° C., fuses the aggregated particles or coalesces the particles to toner composites of resin and pigment, and optionally charge control agent. Furthermore, in other embodiments the ionic surfactants can be exchanged, such that the pigment mixture contains the pigment particle and anionic surfactant, and the suspended resin particle mixture contains the resin particles and cationic surfactant; followed by the ensuing steps as illustrated herein to enable flocculation by charge neutralization while shearing, and forming statically bound aggregate particles by stirring and heating from 20° C. to 5° C. below the resin Tg. When the aggregates are formed, heating to 5° C. to 50° C. above the resin Tg to form stable toner composite particles is accomplished. Of importance with respect to the processes of the present invention is controlling the amount of the cationic surfactant added to cause the aggregation of the anionic latex with the pigment particles, and optional charge controlling agent to form toner particles since there is certain minimum concentration of the cationic surfactant that can be selected to cause the aggregation, Critical Cationic Concentration (CCC), which can be quantified in terms of the molar ratio of cationic surfactant, added to cause the aggregation, to the anionic surfactant present in the latex, for example in the range of 0.2:1 to 2.0:1 molar ratio, and about 0.1:1 to about 5:1. The amount of cationic surfactant can also affect the rate of aggregation, for example this amount can speed the aggregation process by about 2 to 10 times, especially initially. More specifically, the formation of aggregates is much faster, from 2 to 10 times when the concentration of flocculant is higher, for example is increased from 0.2 to 1 percent by the weight of water, and the size of the toner particles increases from about 3 to 9 microns with the increase of from about 0.5:1 to 4:1 molar ratio of the concentration of the cationic surfactant, and the particle size distribution improves from 1.4 to 1.18 initially with an increase of from about 0.5:1 to 2:1 concentration of cationic surfactant.

In reprographic technologies, such as xerographic and ionographic devices, toners with average volume diameter particle sizes of from about 9 microns to about 20 microns are effectively utilized. Moreover, in some xerographic technologies, such as the high volume Xerox Corporation 5090 copier-duplicator, high resolution characteristics and low image noise are highly desired, and can be attained utilizing the small sized toners of the present invention with an average volume particle of less than 11 microns and preferably less than about 7 microns and with narrow geometric size distribution (GSD) of from about 1.16 to about 1.3. Additionally, in some xerographic systems wherein process color is utilized such as pictorial color applications, small particle size colored toners of from about 3 to about 9 microns are highly desired to avoid paper curling. Paper curling is especially observed in pictorial or process color applications wherein three to four layers of toners are transferred and fused onto paper. During the fusing step, moisture is driven off from the paper due to the high fusing temperatures of from about 130° to 160° C. applied to the paper from the fuser. Where only one layer of toner is present, such as in black or in highlight xerographic applications, the amount of moisture driven off during fusing is reabsorbed proportionally by paper and the resulting print remains relatively flat with minimal curl. In pictorial color process applications wherein three to four colored toner layers are present, a thicker toner plastic level present after the fusing step inhibits the paper from sufficiently absorbing the moisture lost during the fusing step, and image paper curling results. These and other disadvantages and problems are avoided or minimized with the toners and processes of the present invention. It is preferable to use small toner particle sizes, such as from about 1 to 7 microns, and with higher pigment loading, such as from about 5 to about 12 percent by weight of toner, such that the mass of toner layers deposited onto paper is reduced to obtain the same quality of image and resulting in a thinner plastic toner layer onto paper after fusing, thereby minimizing or avoiding paper curling. Toners prepared in accordance with the present invention enable the use of lower fusing temperatures, such as from about 120° C. to about 150° C., thereby avoiding or minimizing paper curl. Lower fusing temperatures minimize the loss of moisture from paper, thereby reducing or eliminating paper curl. Furthermore, in process color applications and especially in pictorial color applications, toner to paper gloss matching is highly desirable. Gloss matching is referred to as matching the gloss of the toner image to the gloss of the paper. For example, when a low gloss image of preferably from about 1 to about 30 gloss is desired, low gloss paper is utilized such as from about 1 to about 30 gloss units as measured by the Gardner Gloss metering unit, and which after image formation with small particle size toners of from about 3 to about 5 microns, and fixing thereafter results in a low gloss toner image of from about 1 to about 30 gloss units as measured by the Gardner Gloss metering unit. Alternatively, if higher image gloss is desired, such as from about above 30 to about 60 gloss units as measured by the Gardner Gloss metering unit, higher gloss paper is utilized such as from about above 30 to about 60 gloss units, and which after image formation with small particle size toners of the present invention of from about 3 to about 5 microns and fixing thereafter results in a higher gloss toner image of from about 30 to about 60 gloss units as measured by the Gardner Gloss metering unit. The aforementioned toner to paper matching can be attained with small particle size toners such as less than 7 microns and preferably less than 5 microns, such as from about 1 to about 4 microns, such that the pile height of the toner layer(s) is low.

Numerous processes are known for the preparation of toners, such as, for example, conventional processes wherein a resin is melt kneaded or extruded with a pigment, micronized and pulverized to provide toner particles with an average volume particle diameter of from about 9 microns to about 20 microns and with broad geometric size distribution of from about 1.4 to about 1.7. In such processes, it is usually necessary to subject the aforementioned toners to a classification procedure such that the geometric size distribution of from about 1.2 to about 1.4 is attained. Also, in the aforementioned conventional process, low toner yields after classifications may be obtained. Generally, during the preparation of toners with average particle size diameters of from about 11 microns to about 15 microns, toner yields range from about 70 percent to about 85 percent after classification. Additionally, during the preparation of smaller sized toners with particle sizes of from about 7 microns to about 11 microns, lower toner yields are obtained after classification, such as from about 50 percent to about 70 percent. With the processes of the present invention in embodiments, small average particle sizes of from about 3 microns to about 9 microns, and preferably 5 microns are attained without resorting to classification processes, and wherein narrow geometric size distributions are attained, such as from about 1.16 to about 1.30, and preferably from about 1.16 to about 1.25. High toner yields are also attained such as from about 90 percent to about 98 percent in embodiments. In addition, by the toner particle preparation process of this invention, small particle size toners of from about 3 microns to about 7 microns can be economically prepared in high yields such as from about 90 percent to about 98 percent by weight based on the weight of all the toner material ingredients.

There is illustrated in U.S. Pat. No. 4,996,127 a toner of associated particles of secondary particles comprising primary particles of a polymer having acidic or basic polar groups, and a coloring agent. The polymers selected for the toners of this '127 patent can be prepared by an emulsion polymerization method, see for example columns 4 and 5 of this patent. In column 7 of this '127 patent, it is indicated that the toner can be prepared by mixing the required amount of coloring agent and optional charge additive with an emulsion of the polymer having an acidic or basic polar group obtained by emulsion polymerization. Also, note column 9, lines 50 to 55, wherein a polar monomer, such as acrylic acid, in the emulsion resin is necessary, and toner preparation is not obtained without the use, for example, of acrylic acid polar group, see Comparative Example I. The process of the present invention need not utilize polymer polar acid groups, and toners can be prepared with resins such as poly(styrene-butadiene) or PLIOTONE TM without containing polar acid groups. Additionally, the toner of the '127 patent does not utilize counterionic surfactant and flocculation process as does the present invention. In U.S. Pat. No. 4,983,488, a process for the preparation of toners by the polymerization of a polymerizable monomer dispersed by emulsification in the presence of a colorant and/or a magnetic powder to prepare a principal resin component and then effecting coagulation of the resulting polymerization liquid in such a manner that the particles in the liquid after coagulation have diameters suitable for a toner. It is indicated in column 9 of this patent that coagulated particles of 1 to 100, and particularly 3 to 70, are obtained. This process is thus directed to the use of coagulants, such as inorganic magnesium sulfate, which results in the formation of particles with wide GSD. Furthermore, the '488 patent does not disclose the process of counterionic flocculation as the present invention. Similarly, the aforementioned disadvantages are noted in other prior art, such as U.S. Pat. No. 4,797,339, wherein there is disclosed a process for the preparation of toners by resin emulsion polymerization, wherein similar to the '127 patent polar resins of oppositely charges are selected, and wherein flocculation as in the present invention is not disclosed; and U.S. Pat. No. 4,558,108, wherein there is disclosed a process for the preparation of a copolymer of styrene and butadiene by specific suspension polymerization. Other patents mentioned are U.S. Pat. Nos. 3,674,736; 4,137,188 and 5,066,560.

In U.S. Pat. No. 5,290,654, the disclosure of which is totally incorporated herein by reference, there is disclosed a process for the preparation of toners comprised of dispersing a polymer solution comprised of an organic solvent, and a polyester and homogenizing and heating the mixture to remove the solvent and thereby form toner composites. Additionally, there is disclosed in U.S. Pat. No. 5,278,020, the disclosure of which is totally incorporated herein by reference, a process for the preparation of in situ toners comprising an halogenization procedure which chlorinates the outer surface of the toner and results in enhanced blocking properties. More specifically, this patent application discloses an aggregation process wherein a pigment mixture, containing an ionic surfactant, is added to a resin mixture, containing polymer resin particles of less than 1 micron, nonionic and counterionic surfactant, and thereby causing a flocculation which is dispersed to statically bound aggregates of about 0.5 to about 5 microns in volume diameter as measured by the Coulter Counter, and thereafter heating to form toner composites or toner compositions of from about 3 to about 7 microns in volume diameter and narrow geometric size distribution of from about 1.2 to about 1.4, as measured by the Coulter Counter, and which exhibit, for example, low fixing temperature of from about 125° C. to about 150° C., low paper curling, and image to paper gloss matching.

In U.S. Pat. No. 5,308,734, the disclosure of which is totally incorporated herein by reference, there is illustrated a process for the preparation of toner compositions which comprises generating an aqueous dispersion of toner fines, ionic surfactant and nonionic surfactant, adding thereto a counterionic surfactant with a polarity opposite to that of said ionic surfactant, homogenizing and stirring said mixture, and heating to provide for coalescence of said toner fine particles.

In copending patent application U.S. Ser. No. 022,575, the disclosure of which is totally incorporated herein by reference, there is disclosed a process for the preparation of toner compositions comprising (i) preparing a pigment dispersion in a water, which dispersion is comprised of a pigment, an ionic surfactant and optionally a charge control agent;

(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of the formed particles of pigment, resin and charge control agent to form electrostatically bound toner size aggregates; and (iii) heating the statically bound aggregated particles above the Tg to form said toner composition comprised of polymeric resin, pigment and optionally a charge control agent.

In copending patent application U.S. Ser. No. 082,651, filed concurrently herewith, the disclosure of which is totally incorporated herein by reference, there is illustrated a process for the preparation of toner compositions with controlled particle size comprising:

(i) preparing a pigment dispersion in water, which dispersion is comprised of pigment, an ionic surfactant and an optional charge control agent;

(ii) shearing at high speeds the pigment dispersion with a polymeric latex comprised of resin, a counterionic surfactant with a charge polarity of opposite sign to that of said ionic surfactant, and a nonionic surfactant thereby forming a uniform homogeneous blend dispersion comprised of resin, pigment, and optional charge agent;

(iii) heating the above sheared homogeneous blend below about the glass transition temperature (Tg) of the resin while continuously stirring to form electrostatically bound toner size aggregates with a narrow particle size distribution;

(iv) heating the statically bound aggregated particles above about the Tg of the resin particles to provide coalesced toner comprised of resin, pigment and optional charge control agent, and subsequently optionally accomplishing (v) and (vi);

(v) separating said toner; and (vi) drying said toner.

In copending patent application U.S. Ser. No. 083,157, filed concurrently herewith, the disclosure of which is totally incorporated herein by reference, there is illustrated a process for the preparation of toner compositions with controlled particle size comprising:

(i) preparing a pigment dispersion in water, which dispersion is comprised of a pigment, an ionic surfactant in amounts of from about 0.5 to about 10 percent by weight of water, and an optional charge control agent;

(ii) shearing the pigment dispersion with a latex mixture comprised of a counterionic surfactant with a charge polarity of opposite sign to that of said ionic surfactant, a nonionic surfactant and resin particles, thereby causing a flocculation or heterocoagulation of the formed particles of pigment, resin and charge control agent;

(iii) stirring the resulting sheared viscous mixture of (ii) at from about 300 to about 1,000 revolutions per minute to form electrostatically bound substantially stable toner size aggregates with a narrow particle size distribution;

(iv) reducing the stirring speed in (iii) to from about 100 to about 600 revolutions per minute and subsequently adding further anionic or nonionic surfactant in the range of from about 0.1 to about 10 percent by weight of water to control, prevent, or minimize further growth or enlargement of the particles in the coalescence step (iii); and (v) heating and coalescing from about 5° to about 50° C. above about the resin glass transition temperature, Tg, which resin Tg is from between about 45° to about 90° C. and preferably from between about 50° and about 80° C., the statically bound aggregated particles to form said toner composition comprised of resin, pigment and optional charge control agent.

In copending patent application U.S. Ser. No. 082,741, filed concurrently herewith, the disclosure of which is totally incorporated herein by reference, there is illustrated a process for the preparation of toner compositions with controlled particle size and selected morphology comprising (i) preparing a pigment dispersion in water, which dispersion is comprised of pigment, ionic surfactant, and optionally a charge control agent;

(ii) shearing the pigment dispersion with a polymeric latex comprised of resin of submicron size, a counterionic surfactant with a charge polarity of opposite sign to that of said ionic surfactant and a nonionic surfactant thereby causing a flocculation or heterocoagulation of the formed particles of pigment, resin and charge control agent, and generating a uniform blend dispersion of solids of resin, pigment, and optional charge control agent in the water and surfactants;

(iii) (a) continuously stirring and heating the above sheared blend to form electrostatically bound toner size aggregates; or (iii) (b) further shearing the above blend to form electrostatically bound well packed aggregates; or (iii) (c) continuously shearing the above blend, while heating to form aggregated flake-like particles;

(iv) heating the above formed aggregated particles about above the Tg of the resin to provide coalesced particles of toner; and optionally (v) separating said toner particles from water and surfactants; and (vi) drying said toner particles.

In copending patent application U.S. Ser. No. 082,660, filed concurrently herewith, the disclosure of which is totally incorporated herein by reference, there is illustrated a process for the preparation of toner compositions comprising:

(i) preparing a pigment dispersion, which dispersion is comprised of a pigment, an ionic surfactant, and optionally a charge control agent;

(ii) shearing said pigment dispersion with a latex or emulsion blend comprised of resin, a counterionic surfactant with a charge polarity of opposite sign to that of said ionic surfactant and a nonionic surfactant;

(iii) heating the above sheared blend below about the glass transition temperature (Tg) of the resin to form electrostatically bound toner size aggregates with a narrow particle size distribution; and (iv) heating said bound aggregates above about the Tg of the resin.

In copending patent application U.S. Ser. No. 083,116, filed concurrently herewith, the disclosure of which is totally incorporated herein by reference, there is illustrated a process for the preparation of toner compositions comprising (i) preparing a pigment dispersion in water, which dispersion is comprised of pigment, a counterionic surfactant with a charge polarity of opposite sign to the anionic surfactant of (ii) and optionally a charge control agent;

(ii) shearing the pigment dispersion with a latex comprised of resin, anionic surfactant, nonionic surfactant, and water; and wherein the latex solids content, which solids are comprised of resin, is from about 50 weight percent to about 20 weight percent thereby causing a flocculation or heterocoagulation of the formed particles of pigment, resin and optional charge control agent; diluting with water to form a dispersion of total solids of from about 30 weight percent to 1 weight percent, which total solids are comprised of resin, pigment and optional charge control agent contained in a mixture of said nonionic, anionic and cationic surfactants;

(iii) heating the above sheared blend at a temperature of from about 5° to about 25° C. below about the glass transition temperature (Tg) of the resin while continuously stirring to form toner sized aggregates with a narrow size dispersity; and (iv) heating the electrostatically bound aggregated particles at a temperature of from about 5° to about 50° C. above about the Tg of the resin to provide a toner composition comprised of resin, pigment and optionally a charge control agent.

SUMMARY OF THE INVENTION

It is an object of the present invention to provide toner processes with many of the advantages illustrated herein.

In another object of the present invention there are provided simple and economical processes for the direct preparation of black and colored toner compositions with, for example, excellent pigment dispersion and narrow GSD.

In another object of the present invention there are provided simple and economical in situ processes for black and colored toner compositions by an aggregation process comprised of (i) preparing a cationic pigment mixture, containing optional pigment particles, and optionally charge control agents and other known optional additives dispersed in water containing a cationic surfactant by shearing, microfluidizing or ultrasonifying; (ii) shearing the pigment mixture with a latex mixture comprised of a polymer resin, anionic surfactant and nonionic surfactant thereby causing a flocculation or heterocoagulation, which on further stirring allows the formation of electrostatically stable aggregates; and (iii) heating the aggregate mixture for coalescence and fusing of the particles to prepare toner composites of resin, pigment, and optionally the charge agent.

In a further object of the present invention there is provided a process for the preparation of toners with an average particle diameter of from between about 1 to about 50 microns, and preferably from about 1 to about 7 microns, and with a narrow GSD of from about 1.2 to about 1.3 and preferably from about 1.16 to about 1.25 as measured by the Coulter Counter.

In a further object of the present invention there is provided a process for the preparation of toners with particle size, which can be controlled by controlling the amount of the flocculant added to the latex to cause its flocculation.

In a further object of the present invention there is provided a process for the preparation of toners with a particle size distribution, which can be improved from 1.3 to about 1.16 as measured by the Coulter Counter, by increasing the amount of the flocculant added to from 0.5 molar ratio to 1.0 molar ratio of cationic surfactant added to cause the flocculation to the anionic surfactant present in the latex.

Moreover, in a further object of the present invention there is provided a process for the preparation of toners which after fixing to paper substrates results in images with gloss of from 20 GGU up to 70 GGU as measured by Gardner Gloss meter matching of toner and paper.

In another object of the present invention there are provided composite polar or nonpolar toner compositions in high yields of from about 90 percent to about 100 percent by weight of toner without resorting to classification.

In yet another object of the present invention there are provided toner compositions with low fusing temperatures of from about 110° C. to about 150° C. and with excellent blocking characteristics at from about 50° C. to about 60° C.

Moreover, in another object of the present invention there are provided toner compositions with high projection efficiency such as from about 75 to about 95 percent efficiency as measured by the Match Scan II spectrophotometer available from Milton-Roy.

In a further object of the present invention there are provided toner compositions which result in low or no paper curl.

Another object of the present invention resides in processes for the preparation of small sized toner particles with narrow GSDs, and excellent pigment dispersion by the aggregation of latex particles, or the aggregation of suspension particles with pigment particles dispersed in water and surfactant, and wherein the aggregated particles of toner size can then be caused to coalesce by, for example, heating. In embodiments, factors of importance with respect to controlling particle size and GSD include the concentration of the surfactant in the range of, for example, 0.01 percent to 10 percent by weight of water, or 0.2:1 to 4:1 by molar ratio selected to cause the flocculation or aggregation of the latex particles with the pigment particles, the temperature and the time.

These and other objects of the present invention are accomplished in embodiments by the provision of toners and processes thereof. In embodiments of the present invention, there are provided processes for the economical direct preparation of toner compositions by an improved flocculation or heterocoagulation, and coalescence processes and wherein the amount of cationic surfactant selected can be utilized to control the final toner particle size, that is average volume diameter.

In embodiments, the present invention is directed to processes for the preparation of toner compositions, which comprises initially attaining or generating an ionic pigment dispersion, for example dispersing an aqueous mixture of a pigment or pigments, such as phthalocyanine, quinacridone or Rhodamine B type with a cationic surfactant such as benzalkonium chloride, by utilizing a high shearing device, such as a Brinkmann Polytron, sonicator or microfluidizer, thereafter shearing this mixture by utilizing a high shearing device, such as a Brinkmann Polytron, with a suspended resin mixture comprised of polymer particles, such as poly(styrenebutadiene) or poly(styrenebutylacrylate) and of a particle size ranging from about 0.01 to about 0.5 micron, in an aqueous surfactant mixture containing an anionic surfactant, such as sodium dodecylbenzene sulfonate and nonionic surfactant; resulting in a flocculation, or heterocoagulation of the resin particles with the pigment particles caused by the neutralization of anionic surfactant absorbed on the resin particles with the oppositely charged cationic surfactant absorbed on the pigment; and further stirring the mixture using a mechanical stirrer at 250 to 500 rpm and allowing the formation of electrostatically stabilized aggregates ranging from about 0.5 micron to about 10 microns; followed by heating above the resin Tg and washing with, for example, hot water to remove surfactant, and drying such as by use of an Aeromatic fluid bed dryer, freeze dryer, or spray dryer; whereby toner particles comprised of resin and pigment with various particle size diameters can be obtained, such as from about 1 to about 20 microns in average volume particle diameter as measured by the Coulter Counter.

Embodiments of the present invention include a process for the preparation of toner compositions comprising (i) preparing a pigment dispersion in a water, which dispersion is comprised of a pigment, an ionic surfactant and optionally a charge control agent;

(ii) shearing the pigment dispersion with a latex mixture comprised of a counterionic surfactant with a charge polarity of opposite sign to that of said ionic surfactant, a nonionic surfactant and resin;

(iii) stirring the homogenized mixture thereby causing a flocculation or heterocoagulation of the formed particles of pigment, resin and charge control agent to form electrostatically bounded or attached toner size aggregates; and (iv) heating the statically bound aggregated particles to form said toner composition comprised of polymeric resin, pigment and optionally a charge control agent.

Also, in embodiments the present invention is directed to processes for the preparation of toner compositions which comprises (i) preparing an ionic pigment mixture by dispersing a pigment, such as carbon black like REGAL 330®, HOSTAPERM PINK TM, or PV FAST BLUE TM, of from about 2 to about 10 percent by weight of the toner product in an aqueous mixture containing a cationic surfactant, such as dialkylbenzene dialkylammonium chloride like SANIZOL B-50 TM available from KAO or MIRAPOL TM available from Alkaril Chemicals, of from about 0.01 to about 5 percent by weight of water, utilizing a high shearing device such as a Brinkman Polytron or IKA homogenizer at a speed of from about 3,000 revolutions per minute to about 10,000 revolutions per minute for a duration of from about 1 minute to about 120 minutes; (ii) adding the aforementioned ionic pigment mixture to an aqueous suspension of resin particles comprised of, for example, poly(styrenebutylacrylate), PLIOTONE TM or poly(styrenebutadiene) of from about 88 percent to about 98 percent by weight of the toner, and of about 0.1 micron to about 3 microns polymer particle size in volume average diameter, and counterionic surfactant, such as an anionic surfactant such as sodium dodecyl sulfate, dodecylbenzene sulfonate or NEOGEN R TM, from about 0.5 to about 2 percent by weight of water, a nonionic surfactant such as polyethylene glycol or polyoxyethylene glycol nonyl phenyl ether or IGEPAL 897 TM obtained from GAF Chemical Company, of from about 0.1 to about 3 percent by weight of water, thereby causing a flocculation or heterocoagulation of pigment, charge control additive and resin particles; (iii) diluting the aggregate particle mixture with water from about 50 percent of solids comprised of polymeric particles and pigment particles to about 15 percent of solids; (iv) homogenizing the resulting flocculent mixture with a high shearing device, such as a Brinkmann Polytron or IKA homogenizer, at a speed of from about 3,000 revolutions per minute to about 10,000 revolutions per minute for a duration of from about 1 minute to about 120 minutes, thereby resulting in a homogeneous mixture of latex and pigment, and further stirring with a mechanical stirrer from about 250 to about 500 rpm to form electrostatically stable aggregates of from about 0.5 micron to about 5 microns in average volume diameter; (v) heating the statically bound aggregate composite particles at from about 60° C. to about 95° C. and for a duration of about 60 minutes to about 600 minutes to form toner sized particles of from about 3 microns to about 20 microns in volume average diameter and with a geometric size distribution of from about 1.2 to about 1.3 as measured by the Coulter Counter; and (vi) isolating the toner sized particles by washing, filtering and drying thereby providing a composite toner composition. Additives to improve flow characteristics and charge additives to improve charging characteristics may then be added by blending with the toner, such additives including AEROSILS ® or silicas, metal oxides like tin, titanium and the like of from about 0.1 to about 10 percent by weight of the toner.

One preferred method of obtaining a pigment dispersion can depends on the form of pigment utilized. In some instances, pigments are available in the wet cake or concentrated form containing water, and can be easily dispersed utilizing a homogenizer or stirring. In other instances, pigments are available in a dry form, whereby dispersion in water is effected by microfluidizing using, for example, a M-110 microfluidizer and passing the pigment dispersion from 1 to 10 times through the chamber, or by sonication, such as using a Branson 700 sonicator, with the optional addition of dispersing agents, such as the aforementioned ionic or nonionic surfactants.

The resins selected for the process of the present invention are preferably prepared from emulsion polymerization techniques, and the monomers utilized in such processes can be selected from the group consisting of styrene, acrylates, methacrylates, butadiene, isoprene, and optionally acid or basic olefinic monomers, such as acrylic acid, methacrylic acid, acrylamide, methacrylamide, quaternary ammonium halide of dialkyl or trialkyl acrylamides or methacrylamide, vinylpyridine, vinylpyrrolidone, vinyl-N-methylpyridinium chloride and the like. The presence of acid or basic groups is optional, and such groups can be present in various amounts of from about 0.1 to about 10 percent by weight of the polymer resin. Known chain transfer agents, such as dodecanethiol or carbontetrachloride, can also be selected when preparing resin particles by emulsion polymerization. Other processes of obtaining resin particles of from about 0.01 micron to about 3 microns can be selected from polymer microsuspension process, such as disclosed in U.S. Pat. No. 3,674,736, the disclosure of which is totally incorporated herein by reference, polymer solution microsuspension process, such as disclosed in U.S. Pat. No. 5,290,654, the disclosure of which is totally incorporated herein by reference, mechanical grinding process, or other known processes. The resins selected may also be purchased, or are available from a number of sources.

Various known colorants or pigments including those as illustrated herein, such as carbon black like REGAL 330 ®, cyan, magenta, yellow, blue, green, brown, and mixtures thereof, and the like present in the toner in an effective amount of, for example, from about 1 to about 25 percent by weight of the toner, and preferably in an amount of from about 1 to about 15 weight percent can be selected. Without pigment transparent toners can be obtained.

The toner may also include known charge additives in effective amounts of, for example, from 0.1 to 5 weight percent, such as alkyl pyridinium halides, bisulfates, the charge control additives of U.S. Pat. Nos. 3,944,493; 4,007,293; 4,079,014; 4,394,430 and 4,560,635, which illustrates a toner with a distearyl dimethyl ammonium methyl sulfate charge additive, the disclosures of which are totally incorporated herein by reference, negative charge additives like aluminum couplers, and the like.

Surfactants in amounts of, for example, 0.1 to about 25 weight percent in embodiments can include, for example, nonionic surfactants such as polyoxyethylene stearyl ether, polyoxyethylene nonylphenyl ether, and dialkylphenoxy poly(ethyleneoxy)ethanol, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate. An effective concentration of the nonionic surfactant is, for example, from about 0.01 to about 10 percent by weight, and preferably from about 0.02 to about 2 percent by total weight of the aqueous mixture.

Examples of anionic surfactants selected for the preparation of toners and the processes of the present invention include, for example, sodium dodecyl sulfate (SDS), sodium dodecylbenzene sulfonate, sodium dodecylnaphthalene sulfate, dialkyl benzenealkyl, sulfates and sulfonates, abitic acid, available from Aldrich, NEOGEN R TM, NEOGEN SC TM from Kao and the like. An effective concentration of the anionic surfactant generally employed is, for example, from about 0.01 to about 10 percent by weight, and preferably from about 0.1 to about 5 percent by total weight of aqueous mixture.

Examples of cationic surfactants selected for the toners and processes of the present invention are, for example, dialkyl benzenealkyl ammonium chloride, caprylamine(1-octylamine), caprylamine (1-decylamine), laurylamine (1-dodecylamine), myristylamine (1-tetradecylamine), palmitylamine (cetylamine or 1-hexadecylamine), stearylamine (1-octadecylamine), oleylamine (1-octadecenylamine), arachidylamine (1-eicosylamine), behenylamine (1-docosylamine), dilaurylamine (di-n-dodecylamine), lauryldimethylamine (n-dodecyldimethylamine), dioctadecylamine, ditetradecylamine, trioctadecylamine, lauryl trimethyl ammonium chloride, alkylbenzyl methyl ammonium chloride, alkyl benzyl dimethyl ammonium bromide, benzalkonium chloride, $C_{12}$, $C_{15}$, $C_{17}$ trimethyl ammonium bromides, laurylpyridinium chloride, laurylpyridinium bromide, laurylpyridinium bisulfate, laurylpyridinium-5-chloro-2-mercaptobenzothiazole, laurylpicolinium-p-toluenosulfonate, tetradecylpyridinium bromide, cetyl pyridinium chloride, cetyl pyridinium bromide, 4-alkylmercaptopyridine; poly(vinylpyridine), poly(vinylmethylpyridinium bromide), poly(vinylpyridine)-dodecyl bromide, dodecylbenzyl triethyl ammonium chloride, MIRAPOL TM and ALKAQUAT TM available from Alkaril Chemical Company, SANIZOL TM (benzalkonium chloride), available from Kao Chemicals, and the like, and mixtures thereof. This surfactant is utilized in various effective amounts, such as for example from about 0.01 percent to about 5 percent by weight of water. Preferably, the molar ratio of the cationic surfactant used for flocculation to the anionic surfactant used in the latex preparation is in a range of about 0.5 to about 4, preferably from about 0.5 to about 2.

Surface additives that can be added to the toner compositions after washing or drying include, for example, metal salts, metal salts of fatty acids, colloidal silicas, mixtures thereof and the like, which additives are usually present in an amount of from about 0.1 to about 2 weight percent, reference U.S. Pat. Nos. 3,590,000; 3,720,617; 3,655,374 and 3,983,045, the disclosures of which are totally incorporated herein by reference. Preferred additives include zinc stearate and AEROSIL R972 ® available from Degussa in amounts of from 0.1 to 2 percent which can be added during the aggregation process or blended into the formed toner product.

Developer compositions can be prepared by mixing the toners obtained with the processes of the present invention with known carrier particles, including coated carriers, such as steel, ferrites, and the like, reference U.S. Pat. Nos. 4,937,166 and 4,935,326, the disclosures of which are totally incorporated herein by reference, for example from about 2 percent toner concentration to about 8 percent toner concentration. Imaging methods, as illustrated, for example, in U.S. Pat. No. 4,265,990, the disclosure of which is totally incorporated herein by reference, are also envisioned in embodiments of the present invention.

Embodiments of the present invention include a process for the preparation of a toner with controlled particle sizes of from about 3 to about 20 microns in average volume diameter, which process comprises:

(i) preparing by emulsion polymerization of styrene, butylacrylate and acrylic acid in the concentration of from about 20 percent to about 50 percent using an amonium persulfate as an initiator in a concentration of from 0.5 percent to 5 percent and dodecanethiol as a chain transfer agent in the concentration of from about 0.5 percent to 5 percent and in a mixture of 1 to 3 percent solution of nonoionic surfactant, for example ANTAROX 897 TM, and 1 to 3 percent solution of anionic surfactant, for example NEOGEN R TM, anionic polymeric latex of a submicron particle size of from about 0.1 to about 3 microns consisting of 20 to 50 percent of solids or polymeric particles of poly(styrene-butylacrylate-acrylic acid) in water anionic/-nonionic surfactant and with an effective charge mobility or zeta potential of from about −70 to about −120 millivolts;

(ii) preparing by sonication, homogenization or microfluidization a pigment dispersion, which dispersion is comprised of a pigment, a controlled amount of from about 0.01 to about 10 weight percent of cationic surfactant, for example SANIZOL B-50 TM, and a charge control agent;

(iii) shearing by the high shear blender, for example polytron or homogenizer at 5,000 to 15,000 rpm, the pigment dispersion (ii) with a polymeric latex (i) comprised of resin, a counterionic surfactant with a negative charge of −70 to −120 millivolts which is an opposite polarity to that of pigment dispersion which was prepared with cationic surfactant, thereby causing a flocculation or heterocoagulation of the formed particles of pigment, resin and charge control agent to form a uniform dispersion of solids consisting of polymeric latex, pigment, and optional charge controlling agent;

(iv) stirring at from about 200 to 500 revolutions per minute for from about 1 to about 24 hours the above sheared blend of latex particles and oppositely charged pigment particles to form electrostatically bound sufficiently stable to withstand Coulter Counter measurements, toner size aggregates with a narrow particle size distribution, or GSD of from about 1.16 to about 1.26 as determined on the Coulter Counter;

(v) heating the statically bound aggregated particles at a temperature of from about 5° C. to about 50° C. above or equal to the Tg of the resin (which is usually in the range of from 50° C. to 80° C. and preferably in the range of from 52° C. to 65° C.); to provide a mechanically stable (to withstand the development in the machine) toner particles comprised of polymeric resin, pigment and optionally a charge control agent; and optionally (vi) separating the toner particles by filtration; and (vii) drying the toner particles; a process for the preparation of toner compositions with a volume median particle of from about 1 to about 25 microns, which process comprises:

(i) preparing by emulsion polymerization an anionic charged polymeric latex of submicron particle size; and which latex is comprised of resin and an anionic surfactant, and optional nonionic surfactant;

(ii) preparing a pigment dispersion in water, which dispersion is comprised of a pigment, an effective amount of cationic flocculant surfactant, and optionally a charge control agent;

(iii) shearing the pigment dispersion (ii) with the polymeric latex (i) thereby causing a flocculation or heterocoagulation of the formed particles of pigment, resin and charge control agent to form a high viscosity gel in which solid particles are uniformly dispersed;

(iv) stirring the above gel comprised of latex particles, and oppositely charged pigment particles for an effective period of time to form electrostatically bound relatively stable toner size aggregates with narrow particle size distribution; and (v) heating the electrostatically bound aggregated particles at a temperature above the resin glass transition temperature (Tg) thereby providing said toner composition comprised of resin, pigment and optionally a charge control agent; and a process for the preparation of toner with particle sizes of from about 1 to about 25 microns in average volume diameter, which process comprises:

(i) preparing by emulsion polymerization a negatively charged polymeric latex of a submicron particle size, which size is from about 30 nanometers to about 700 nanometers, and an effective charge mobility or zeta potential of from about −70 to about −120 millivolts;

(ii) preparing a pigment dispersion, which dispersion is comprised of a pigment, a controlled effective amount of from about 1 to about 10 weight percent of cationic surfactant, and optionally a charge control agent;

(iii) shearing the pigment dispersion (ii) with the polymeric latex of (i), which latex is comprised of resin, a counterionic surfactant, and more specifically an anionic surfactant with a charge polarity of opposite sign to that of said cationic surfactant, thereby causing a flocculation or heterocoagulation of the formed particles of pigment, resin and charge control agent to form a uniform dispersion of solids comprised of resin, pigment, and optionally a charge control agent;

(iv) stirring at from about 200 to 500 revolutions per minute for from about 1 to about 24 hours the above sheared blend of latex particles and oppositely charged pigment particles to form electrostatically bound relatively stable, as determined by Coulter Counter measurements, toner size aggregates with a narrow particle size distribution, or GSD, of from about 1.16 to about 1.26;

(v) heating the statically bound aggregated particles at a temperature of from about 5° C. to about 50° C. above the Tg of the resin at temperatures of 60° C. to 95° C. to provide a toner composition comprised of resin, pigment, and optionally a charge control agent; and optionally (vi) separating the toner particles; and (vii) drying said toner particles.

A pigment dispersion (ii) without pigment can be selected and can be comprised of water, cationic surfactant and optional charge control agent.

The following Examples are being submitted to further define various species of the present invention. These Examples are intended to be illustrative only and are not intended to limit the scope of the present invention. Also, parts and percentages are by weight unless otherwise indicated.

EXAMPLE I

A polymeric latex was prepared by the emulsion polymerization of styrene/butylacrylate/acrylic acid (80/20/2 parts) in a nonionic/anionic surfactant solution (3 percent) as follows. 352 Grams of styrene, 48 grams of butylacrylate, 8 grams of acrylic acid, and 12 grams of dodecanethiol were mixed with 600 milliliters of deionized water in which 9 grams of sodium dodecyl benzene sulfonate anionic surfactant (NEOGEN R TM which contains 60 percent of active component), 8.6 grams of polyoxyethylene nonyl phenyl ether—nonionic surfactant (ANTAROX 897 TM —70 percent active), and 4 grams of ammonium persulfate initiator were dissolved. The emulsion was then polymerized at 70° C. for 8 hours. The resulting latex contained 60 percent of water and 40 percent of solids, which solids were comprised of particles of poly(styrene butylacrylate acrylic acid); the Tg of the latex dry sample was 53.2° C., as measured on DuPont DSC; $M_w$=20,000, and $M_n$=6,000 as determined on Hewlett Packard GPC. The zeta potential as measured on Pen Kem Inc. Laser Zee Meter was −80 millivolts. The particle size of the latex as measured on Brookhaven BI-90 Particle Nanosizer was 147 nanometers. The aforementioned latex was then selected for the toner preparation of Example I.

Preparation of Transparent Toner Particles (1: 1 Molar Ratio of the Cationic Surfactant)

60 Grams of the above styrene/butylacrylate anionic latex were blended with 0.5 gram of cationic surfactant SANIZOL B-50 TM dissolved in 60 milliliters of water (1:1 ratio) using a high shear homogenizer at 10,000 rpm for 2 minutes forming a flocculation or heterocoagulation of formed gel particles of resin, or polymer of styrene/butylacrylate/acrylic acid 80/20/2, which was a uniform dispersion of solids, 20 percent in 80 percent water, which gel had a viscosity of about 1,200 centipoise. This gel was stirred at room temperature for 24 hours resulting in aggregates which were then coalesced at 70° C. for 2 hours. Toner particles of poly(styrene/butylacrylate/acrylic acid), 4.3 microns average volume diameter with GSD=1.31 as measured by the Coulter Counter, were obtained.

EXAMPLE II

A polymeric latex was prepared by the emulsion polymerization of styrene/butylacrylate/acrylic acid (80/20/2 parts) in a nonionic/anionic surfactant solution (3 percent) as follows. 352 Grams of styrene, 48 grams of butylacrylate, 8 grams of acrylic acid, and 12 grams of dodecanethiol were mixed with 600 milliliters of deionized water in which 9 grams of sodium dodecyl benzene sulfonate anionic surfactant (NEOGEN R TM which contains 60 percent of active component), 8.6 grams of polyoxyethylene nonyl phenyl ether—nonionic surfactant (ANTAROX 897 TM —70 percent active), and 4 grams of ammonium persulfate initiator were dissolved. The emulsion was then polymerized at 70° C. for 8 hours. The resulting latex contained 40 percent of solids comprised of particles of poly(styrene/butylacrylate/acrylic acid); the Tg of the latex dry sample was 53.2° C., as measured on DuPont DSC; $M_w$=20,000, and $M_n$=6,000 as determined on Hewlett Packard GPC. The zeta potential as measured on Pen Kem Inc. Laser Zee Meter was −80 millivolts. The particle size of the latex as measured on Brookhaven BI-90 Particle Nanosizer was 147 nanometers. The aforementioned latex was then selected for the toner preparation of Example II.

Preparation of Toner Particles (2:1 Molar Ratio of the Cationic Surfactant)

60 Grams of the above styrene/butylacrylate anionic latex were blended with 1 gram of cationic surfactant SANIZOL B-50 TM dissolved in 60 milliliters of water (2:1 ratio) with the aim or speed of the homogenizer at 10,000 rpm for 2 minutes forming a flocculation or heterocoagulation of formed gel particles of resin, or polymer of styrene/butylacrylate/acrylic acid 80/20/2, which was a uniform dispersion of solids, 20 percent in 80 percent water, which gel had a viscosity of about 1,600 centipoise. This blend was stirred at room temperature for 24 hours, resulting in aggregates, which were then coalesced at 70° C. for 2 hours. Particles of poly(styrene/butylacrylate/acrylic acid), 5.8 microns average volume diameter with GSD=1.26, were obtained.

EXAMPLE III

A polymeric latex was prepared by the emulsion polymerization of styrene/butylacrylate/acrylic acid (80/20/2 parts) in nonionic/anionic surfactant solution (3 percent) as follows. 352 Grams of styrene, 48 grams of butylacrylate, 8 grams of acrylic acid, and 12 grams of dodecanethiol were mixed with 600 milliliters of deionized water in which 9 grams of sodium dodecyl benzene sulfonate anionic surfactant (NEOGEN R TM which contains 60 percent of active component), 8.6 grams of polyoxyethylene nonyl phenyl ether—nonionic surfactant (ANTAROX 897 TM—70 percent active), and 4 grams of ammonium persulfate initiator were dissolved. The emulsion was then polymerized at 70° C. for 8 hours. The resulting latex contained 40 percent of solids comprised of particles of poly(styrene butylacrylate acrylic acid); the Tg of the latex dry sample was 53.2° C., as measured on DuPont DSC; $M_w$=20,000, and $M_n$=6,000 as determined on Hewlett Packard GPC. The zeta potential as measured on Pen Kem Inc. Laser Zee Meter was −80 millivolts. The particle size of the latex as measured on Brookhaven BI-90 Particle Nanosizer was 147 nanometers. The aforementioned latex was then selected for the toner preparation of Example III.

Preparation of Toner Particles (4:1 Molar Ratio of the Cationic Surfactant)

60 Grams of the above styrene/butylacrylate anionic latex were blended with 2 grams of cationic surfactant SANIZOL B-50 TM dissolved in 60 milliliters of water (4:1 ratio) using a high shear homogenizer at 10,000 rpm for 2 minutes forming a flocculation or heterocoagulation of formed gel particles of resin, or polymer of styrene/butylacrylate/acrylic acid 80/20/2, which was a uniform dispersion of solids, 20 percent in 80 percent water, which gel had a viscosity of about 2,000 centipoise. This gel was stirred at room temperature for 24 hours resulting in aggregates which were then coalesced at 70° C. for 2 hours. Particles of poly(styrene/butylacrylate/acrylic acid) of 8.8 microns average volume diameter with GSD=1.28 were obtained.

TABLE 1

Effect of Flocculant Concentrate on Toner Particle Size and GSD

| Molecular Ratio of the Cationic/Anionic Surfactants | Final (Coalesced) Toner Particles | |
|---|---|---|
| | Part. Size | GSD |
| 1:1 | 4.3 | 1.31 |
| 2:1 | 5.8 | 1.26 |
| 4:1 | 8.8 | 1.28 |

As the data in the Table 1 indicates, with increasing the molar ratio of the cationic surfactant, SANIZOL B-50 TM, added to cause the flocculation of the latex particles, to the anionic surfactant, NEOGEN R TM, present in the latex from 1:1 to 4:1, one can increase the size of the toner particles from 4 microns to about 9 microns.

Colored toner can be prepared with the characteristics indicated herein, especially the Examples, by preparing a pigment dispersion in water (ii), which pigment can be as illustrated herein, such as carbon black.

Other embodiments and modifications of the present invention may occur to those skilled in the art subsequent to a review of the information presented herein; these embodiments and modifications, as well as equivalents thereof, are also included within the scope of this invention.

What is claimed is:

1. A process for the preparation of toner compositions with a volume median particle size of from about 1 to about 25 microns, which process comprises:

(i) preparing by emulsion polymerization an anionic charged polymeric latex of submicron particle size, and comprised of resin particles and anionic surfactant;

(ii) preparing a dispersion in water, which dispersion is comprised of pigment, an effective amount of cationic flocculant surfactant, and optionally a charge control agent;

(iii) shearing the dispersion (ii) with said polymeric latex thereby causing a flocculation or heterocoagulation of pigment, resin and charge control agent to form a high viscosity gel in which particles of pigment, resin and optional charge control agent are uniformly dispersed;

(iv) stirring the above gel for an effective period of time to form electrostatically bound relatively stable toner size aggregates with narrow particle size distribution; and (v) heating the electrostatically bound relative stable toner size aggregates at a temperature above the resin glass transition temperature (Tg) thereby providing said toner compositions comprised of resin, pigment and optional charge control agent.

2. A process in accordance with claim 1 wherein the amount of cationic surfactant, or flocculant added is from about 0.01 to about 10 weight percent, thereby enabling a toner size of from about 3 to about 20 microns.

3. A process in accordance with claim 1 wherein the size of the toner after aggregation and coalescence is controlled by the molar ratio of 0.1:1 to 5:1 and preferably 0.5:1 to 2:1 of the cationic flocculant surfactant, and the counterionic anionic surfactant present in the latex.

4. A process in accordance with claim 1 wherein the size of the toner after aggregation and coalescence can be increased from 2 to 20 microns by increasing from 0.5:1 to 4:1 the molar ratio of the flocculant, or cationic surfactant added to cause said flocculation.

5. A process in accordance with claim 1 wherein the minimum molar ratio of flocculant, or cationic surfactant for enabling flocculation of particles into toner and the anionic surfactant present in the latex is about 0.5:1, and thereby enabling aggregation of the particles in (iv).

6. A process in accordance with claim 1 wherein there is selected a minimum 1:1 ratio of flocculant, or cationic surfactant and anionic surfactant present in the latex to thereby achieve narrow, from about 1.16 to about 1.26, particle size distribution.

7. A process in accordance with claim 1 wherein the flocculant, or cationic surfactant added partially reduces the charge of the anionic latex from about −120 to −70 millivolts to about −60 to 0 millivolts.

8. A process in accordance with claim 1 wherein the size from about 2 to about 20 microns of the aggregated/coalesced particles is controlled by the net charge, in the range of −60 millivolts to 0 millivolts, on the particles after addition of counterionic surfactant.

9. A process in accordance with claim 1 wherein the size of the electrostatically bound relatively stable toner size aggregates is from about 3 to about 20 microns average volume diameter or volume median diameter, and is controlled by the size of the latex particles which are from about 30 to about 500 nanometers in average volume diameter.

10. A process in accordance with claim 1 wherein by increasing said polymeric latex size from 30 to 500 nanometers the size of the electrostatically bound relatively stable toner size aggregates are increased to from about 3 to about 20 microns.

11. A process in accordance with claim 1 wherein the surfactant utilized in preparing the pigment dispersion is a cationic surfactant, and the anionic surfactant present in the latex mixture provides a negatively charged latex.

12. A process in accordance with claim 1 wherein a transparent toner is obtained.

13. A process in accordance with claim 1 wherein the surfactant used as a flocculant, or cationic surfactant enables a positively charged dispersion (ii).

14. A process in accordance with claim 13 wherein the dispersion of pigment in the cationic surfactant is accomplished by homogenizing at from about 1,000 revolutions per minute to about 10,000 revolutions per minute at a temperature of from about 25° C. to about 35° C. for a duration of from about 1 minute to about 120 minutes.

15. A process in accordance with claim 1 wherein the dispersion of pigment in the cationic surfactant is accomplished by an ultrasonic probe at from about 300 watts to about 900 watts of energy, at from about 5 to about 50 megahertz of amplitude, at a temperature of from about 25° C. to about 55° C., and for a duration of from about 1 minute to about 120 minutes.

16. A process in accordance with claim 1 wherein the dispersion of (i) is accomplished by microfluidization in a microfluidizer or in nanojet for a duration of from about 1 minute to about 120 minutes.

17. A process in accordance with claim 1 wherein the cationic surfactant added as a flocculant causes a gel viscosity increase of from about 2 to about 8 centipoise to from about 500 to about 1,000 centipoise.

18. A process in accordance with claim 13 wherein the cationic surfactant added controls the viscosity in the range of from about 10 centipoise to about 5,000 centipoise of the resulting blend.

19. A process in accordance with claim 1 wherein the cationic surfactant is caprylamine(1-octylamine), caprylamine(1-decylamine), laurylamine(1-dodecylamine), myristylamine(1-tetradecylamine), palmitylamine(cetylamine or 1-hexadecylamine), stearylamine(1-octadecylamine), oleylamine(1-octadecenylamine), arachidylamine(1-eicosylamine), behenylamine(1-docosylamine); secondary fatty amines such as, for example, dilaurylamine(di-n-dodecylamine); lauryldimethylamine(n-dodecyldimethylamine); dioctadecylamine, ditetradecylamine, trioctadecylamine, primary fatty amine acetates, or secondary fatty amine acetates; and the cationic surfactant is a quaternary ammonium compound, benzalkonium chlorides, or benzalkonium bromides.

20. A process in accordance with claim 1 wherein the cationic surfactant is laurylpyridinium chloride, laurylpyridinium bromide, laurylpyridinium bisulfate, laurylpyridinium-5-chloro-2mercaptobenzothiazole, laurylpicolinium-p-tolueno sulfonate, tetradecylpyridinium bromide, cetyl pyridinium chloride, cetyl pyridinium bromide, 4-alkylmercaptopyridine, laurylisoquinilinium bromide, laurylisoquinilinium saccharinate, alkylisoquinilinium bromide, substituted imidazolinium compounds octyldimethylbenzyl ammonium chloride, dodecyldimethylbenzyl ammonium chloride, octadecyldimethylbenzyl ammonium chloride, or cetyltrimethyl ammonium bromide.

21. A process in accordance with claim 1 wherein the cationic surfactant is poly(vinylpyridine), poly(vinylmethylpyridinium bromide), poly(vinylpyridine) dodecyl bromide, polysulfonium compounds, poly(triethyl hexadecylphosphonium bromide) or poly(trimethyldodecyl phosphonium bromide).

22. A process in accordance with claim 1 wherein the cationic surfactant is an alkylbenzalkonium chloride present in an effective concentration of from 0.01 percent to 10 percent and preferably from about 0.02 percent to about 2 percent by total weight of the aqueous mixture.

23. A process in accordance with claim 1 wherein the anionic surfactant is selected from the group consisting of sodium dodecyl sulfate, sodium dodecyl benzene sulfate, sodium dodecyl naphthalene sulfate, sodium lauryl sulfate, sodium alkyl naphthalene sulfonate, potassium alkyl sulfonate; and which surfactant is selected in an effective concentration of from 0.01 to 10 percent and preferably from 0.02 to 3 percent by total weight of aqueous mixture.

24. A process in accordance with claim 1 wherein the resin particles utilized in (ii) are from about 0.01 to about 3 microns in average volume diameter.

25. A process in accordance with claim 1 wherein the resin is selected from the group consisting of poly(styrene-butadiene), poly(paramethyl styrene-butadiene), poly(meta-methyl styrene-butadiene), poly(alpha-methylstyrene-butadiene), poly(methylmethacrylate-butadiene), poly(ethylmethacrylate-butadiene), poly(propylmethacrylate-butadiene), poly(butylmethacrylate-butadiene), poly(methylacrylate-butadiene), poly(ethylacrylate-butadiene), poly(propylacrylate-butadiene), poly(butylacrylate-butadiene), poly(styrene-isoprene), poly(para-methyl styrene-isoprene), poly(meta-methyl styrene-isoprene), poly(alpha-methylstyrene-isoprene), poly(methylmethacrylate-isoprene), poly(ethylmethacrylate-isoprene), poly(propylmethacrylate-isoprene), poly(butylmethacrylate-isoprene), poly(methylacrylate-isoprene), poly(ethylacrylate-isoprene), poly(propylacrylate-isoprene), and poly(butylacrylate-isoprene); and which resin is present in said toner in the amount of from about 50 to about 97 percent by the total weight of all toner components.

26. A process in accordance with claim 1 wherein the resin is selected from the group consisting of poly(styrene-butadiene-acrylic acid) poly(styrene-butadiene-methacrylic acid) poly(styrene-butylmethacrylate-acrylic acid), or poly(styrene-butylacrylate-acrylic acid), polyethylene-terephthalate, polypropylene-terephthalate, polybutylene-terephthalate, polypentylene-terephthalate, polyhexalene-terephthalate, polyheptadene-terephthalate, and polyoctalene-terephthalate.

27. A process in accordance with claim 1 wherein polymer latex of (i) contains a nonionic surfactant selected from the group consisting of polyoxyethylene stearyl ether, polyoxyethylene nonylphenyl ether, and dialkylphenoxy poly(ethyleneoxy)ethanol, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyvinyl alcohol, methalose, methyl cellulose, ethyl cellulose, propyl cellulose, hydroxy ethyl cellulose, carboxy methyl cellulose, and which surfactant is selected in an amount of from 0 percent to about 10 percent by weight and preferably from about 0.02 to about 2 percent by weight of the aqueous mixture comprised of anionic surfactant, nonionic surfactant, and water.

28. A process in accordance with claim 1 wherein the pigment is carbon black, cyan, magenta or yellow present in an amount of from about 0.1 to about 10 weight percent.

29. A process in accordance with claim 1 wherein there is added to the toner obtained surface additives of metal salts, metal salts of fatty acids, silicas, or mixtures thereof.

30. A process for the preparation of a toner, which process comprises:

(i) preparing by emulsion polymerization of styrene, butylacrylate and acrylic acid in the concentration of from about 20 percent to about 50 percent with an ammonium persulfate as an initiator in a concentration of from 0.5 percent to 5 percent and dodecanethiol as a chain transfer agent in the concentration of from about 0.5 percent to 5 percent and in a mixture of 1 to 3 percent solution of nonoionic surfactant and 1 to 3 percent solution of anionic surfactant, an anionic polymeric latex of a submicron particle size of from about 0.1 to about 3 microns of 20 to 50 percent of solids of poly(styrene-butylacrylate-acrylic acid) in a water anionic/nonionic surfactant and with an effective charge mobility or zeta potential of from about −70 to about −120 millivolts;

(ii) preparing by sonication, homogenization or microfluidization a pigment dispersion, which dispersion is comprised of a pigment, a controlled amount of from about 0.01 to about 10 weight percent of cationic surfactant, and an optional charge control agent;

(iii) shearing by a high shear blender or homogenizer at 5,000 to 15,000 rpm the pigment dispersion (ii) with a polymeric latex (i) comprised of resin, a counterionic surfactant with a negative charge of −70 to −120 millivolts, and which is an opposite polarity to that of the pigment dispersion which was prepared with the cationic surfactant, thereby causing a flocculation or heterocoagulation of the formed particles of pigment, resin and charge control agent to form a uniform dispersion of solids comprised of a polymeric latex of poly(styrene-co-butylacrylate-co-acrylic acid), pigment, and optional charge controlling agent;

(iv) stirring at from about 200 to 500 revolutions per minute for from about 1 to about 24 hours the above sheared blend of latex particles and oppositely charged pigment particle, to form electrostatically bound relatively stable, to withstand Coulter Counter measurements, toner size aggregates with a narrow particle size distribution, or GSD of from about 1.16 to about 1.26 as determined on the Coulter Counter;

(v) heating the statically bound aggregated particles at a temperature of from about 5° C. to about 50° C. above the Tg of the resin in the range of from about 50° C. to about 80° C. and preferably in the range of from about 52° C. to about 65° C. to provide a toner comprised of said resin, pigment and optionally a charge control agent; and optionally (vi) separating said toner by filtration; and (vii) drying said toner.

31. A process in accordance with claim 1 wherein in (iii) the charge polarity of opposite sign is from about −70 to about −120 millivolts.

32. A process in accordance with claim 3 wherein the toner after aggregation and coalescence is controlled by the molar ratio of 0.1:1 to 5:1 and preferably 0.5:1 to 2:1 of the cationic flocculant surfactant and the counterionic surfactant present in the latex.

33. A process in accordance with claim 1 wherein in (v) the Tg of the resin is in the range of from about 50° C. to about 80° C. and preferably is in the range of from about 52° C. to about 65° C.

34. A process in accordance with claim 1 wherein the amount of cationic flocculant to the anionic surfactant present in the latex is in a molar ratio of from about 0.1:1 to about 5:1.

35. A process in accordance with claim 34 wherein said molar ratio is from about 0.5:1 to about 2:1.

36. A process for the preparation of toner with particle sizes of from about 1 to about 25 microns in average volume diameter, which process comprises:

(i) preparing by emulsion polymerization an anionic charged polymeric latex of a submicron particle size, which size is from about 30 nanometers to about 700 nanometers, and with an effective charge mobility or zeta potential of from about −70 to about −120 millivolts, and which latex is comprised of resin and anionic surfactant;

(ii) preparing a pigment dispersion, which dispersion is comprised of pigment, a controlled effective amount of from about 1 to about 10 weight percent of cationic surfactant, and optionally a charge control agent;

(iii) shearing the pigment dispersion (ii) with said polymeric latex (i), thereby causing a flocculation or heterocoagulation of the formed particles of pigment, resin and optional charge control agent to form a uniform dispersion of solids comprised of resin, pigment, and optional charge control agent;

(iv) stirring at from about 200 to about 500 revolutions per minute for from about 1 to about 24 hours the above sheared blend of latex particles and oppositely charged pigment particles to form electrostatically bound relatively stable, as determined by Coulter Counter measurements, toner size aggregates with a narrow particle size distribution, or GSD, of from about 1.16 to about 1.26;

(v) heating the statically bound aggregated particles at a temperature of from about 5° C. to about 50° C. above the Tg of the resin at temperatures of 60° C. to 95° C. to provide a toner composition comprised of resin, pigment and optionally a charge control agent; and optionally (vi) separating the toner particles; and (vii) drying said toner particles.

37. A process in accordance with claim 36 wherein in (iii) the solids are comprised of from about 85 to about 97 percent of resin, about 3 to about 15 percent of pigment, and about 0 to about 5 percent of charge control agent.

* * * * *